US007802702B2

(12) United States Patent
Archer, Jr.

(10) Patent No.: US 7,802,702 B2
(45) **Date of Patent: *Sep. 28, 2010**

(54) SYSTEM AND METHOD OF POURING LIQUIDS FROM A VESSEL

(76) Inventor: James Blaine Archer, Jr., 1220 Hawthorne Rd., Golden, CO (US) 80401

( * ) Notice: Subject to any disclaimer, the term of this patent is extended or adjusted under 35 U.S.C. 154(b) by 444 days.

This patent is subject to a terminal disclaimer.

(21) Appl. No.: 11/939,403

(22) Filed: Nov. 13, 2007

(65) Prior Publication Data

US 2009/0120964 A1 May 14, 2009

(51) Int. Cl.
*B67D 7/76* (2010.01)

(52) U.S. Cl. ..... 222/189.07; 222/569; 222/570; 99/413; 210/466; 210/469

(58) Field of Classification Search ..... 222/189.07, 222/567, 569–570; 99/413, 417, 375, 400, 99/410, 464, 466, 469; 215/390; 248/37.3; 210/464–469, 475; 220/703–704, 716–717, 220/573.4
See application file for complete search history.

(56) References Cited

U.S. PATENT DOCUMENTS

| | | | | |
|---|---|---|---|---|
| 284,452 | A | 9/1883 | MacKinney | |
| 1,587,934 | A | 6/1926 | Bartlett | |
| 1,867,060 | A | 7/1932 | Carr | |
| 2,315,250 | A | 3/1943 | Eilers | |
| 2,331,971 | A | 10/1943 | Gramp | |
| 2,375,248 | A | 5/1945 | Reese | |
| 2,471,189 | A * | 5/1949 | Bartels | 222/189.07 |
| 2,594,858 | A | 4/1952 | Bowman | |
| 2,657,838 | A | 11/1953 | Kramer et al. | |
| 2,783,924 | A | 3/1957 | Hayes | |
| 3,102,667 | A | 9/1963 | Ullevig | |
| 3,272,407 | A | 9/1966 | Ottestad | |
| 3,697,053 | A * | 10/1972 | Will | 366/343 |
| 3,863,819 | A * | 2/1975 | Storm | 222/569 |
| 3,961,732 | A | 6/1976 | Roberts | |
| 3,994,424 | A | 11/1976 | Koeller | |
| 4,203,537 | A * | 5/1980 | McAlister | 222/570 |
| D284,452 | S | 7/1986 | McKay | |
| 4,900,160 | A | 2/1990 | Brooks et al. | |

(Continued)

OTHER PUBLICATIONS

International Searching Authority "Notification of Transmittal of the International Search Report and the Written Opinion of the International Searching Authority, or the Declaration" Dec. 22. 2008.

*Primary Examiner*—Kevin P Shaver
*Assistant Examiner*—Andrew Bainbridge
(74) *Attorney, Agent, or Firm*—Holland & Hart LLP

(57) ABSTRACT

A system for pouring liquids from a vessel is provided with a mounting flange that engages an inner surface of a vessel sidewall and a spout that extends from the mounting flange. A biasing member depends from the spout to engage an outer surface of the vessel sidewall and securely engage the mounting flange with the inner surface of the vessel sidewall. Guide walls may extend up from the mounting flange on either side of the spout. A separator plate may be removably secured with the mounting flange to strain solids from the liquid being poured from the vessel. The spout, alone or in combination with the separator plate my form a utensil support.

20 Claims, 8 Drawing Sheets

U.S. PATENT DOCUMENTS 4,962,599 A * 10/1990 Harris ..... 37/266
5,078,872 A 1/1992 Durant et al.
5,195,662 A 3/1993 Neff
5,579,963 A 12/1996 Murthi
2004/0216620 A1 11/2004 Quiggins et al.
2005/0178805 A1 8/2005 Abrahams
2007/0017934 A1 * 1/2007 PaPasodero ..... 222/189.07
2007/0023463 A1 2/2007 MacClarence

* cited by examiner

SYSTEM AND METHOD OF POURING LIQUIDS FROM A VESSEL

BACKGROUND

Cooks of all types frequently find themselves in the position of needing to pour a liquid from one of various different cooking vessels. Sometimes, this seemingly easy task can be dangerous. For example, some liquids, such as grease, may be quite hot. Accordingly, when the hot grease is poured from a frying pan, the grease may run down the side of the frying pan and spill against the person holding the frying pan, potentially causing serious injury. Errant spills may also cascade down the sides of cooking vessels and come into contact with open flames from a cook top, creating a very real fire hazard. Aside from concerns of injury to the user, pouring liquids from cooking vessels is rarely successful, from the standpoints of depositing all of the liquid into an intended receptacle or preventing messy spills.

Part of the problem associated with successfully pouring liquids from a cooking vessel centers on the shape of the lip of the vessel's sidewalk. Some vessels present rounded lips, which tend to cause liquids to adhere to the lip of the vessel and then cascade down the side of the vessel. The same is frequently true with cooking vessels having multi-facetted lips. The breadth of the cooking vessel opening also tends to cause problems, as the stream of fluid coming from the vessel broadens as the size and shape of the vessel opening increase.

Prior attempts at resolving these problems include forming cooking vessels with integrated spouts. However, such permanent spout features tend to prevent the proper fit of lids and get in the way when the cooking vessel is used for cooking. Other attempts have presented removable spouts for use with cooking vessels, however, such devices are typically cumbersome. More importantly, such devices typically prevent, an adequate seal between the spout and the cooking vessel, permitting liquid to leak between the structures. Loose fitting spouts may fall from the cooking vessel completely as the cooling vessel is tipped through extreme angles.

Even if these problems can be partially addressed, other concerns persist. For example, when a user is cooking and needs to pour liquid from a cooking vessel, the liquid is not alone in the cooking vessel. Solids, such as pasta, crumbled burger, vegetables and the like, are oftentimes cooked in the liquid. It is desirable to separate the liquids from the solids without loosing the solid pieces down a drain or into the liquid receptacle. Regardless of the shape of the cooking vessel, or the inclusion of a spout, the final amount of liquid and the solids can be difficult and time consuming to separate. More times than not, pieces of food are poured from the vessel with the last amount of liquid.

SUMMARY

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

A system is provided for pouring a liquid from a vessel, having at least a bottom wall and a sidewall with inner and outer surfaces and a free circumferential edge portion. The system includes a mounting flange, having first and second opposite surfaces and a free lower edge portion. The mounting flange is shaped to be placed in a use position, closely adjacent the inner surface and circumferential edge portion of the vessel sidewall. A spout, having proximal and distal end portions, is coupled with the mounting flange. The spout forms a fluid pathway along an upper surface of the spout between the proximal and distal end portions. A biasing member, is positioned to depend from the spout and positioned so that, when the mounting flange is placed in a use position, the biasing member at least partially engages the outer surface of the vessel sidewall and biases the first surface of the mounting flange against the inner surface of the vessel sidewall.

In one aspect, a pair of guide walls may be positioned on either side of the spout, extending upwardly from the mounting flange. The guide walls may be shaped to guide materials into the spout as they are poured form the vessel. In another aspect, the guide walls and mounting flange may be formed to be deformably resilient so that the mounting flange may be secured within vessels of differing diameters.

In at least one embodiment, the biasing member is a spring that is shaped to depend downwardly from the spout, toward the mounting flange. In at least one other embodiment, the biasing member includes a bracket that depends from the spout to hold a support pin, which is movable between engagement and release positions. In one aspect, a spring is positioned to engage the support pin and bias it toward its engagement position. An engagement end portion of the support pin may be provided to engage the outer surface of the vessel sidewall when the mounting flange is in its use position and support the system with respect to the vessel.

In one or more embodiments, the system may further include a separator plate, having first and second opposing surfaces and a plurality of drainage holes. In one aspect, the separator plate may be removably coupled with the mounting flange so that an engagement edge portion of the separator plate is positioned closely adjacent the mounting flange, below the spout. In another aspect, a sealing edge portion may be provided to depend from the engagement edge portion of the separator plate to seal against the inner surface of the vessel sidewall when the mounting plate and separator plate are in use positions. In still another aspect, the separator plate may be provided with a recessed area in its first surface that, when the separator plate is in its use position, is in-line with the proximal and distal ends of the spout to provide a support for at least one elongated utensil handle. In another aspect, a support arm, may extend across a width of the spout, adjacent the proximal end portion of the spout to function in conjunction with an upturned lip of the spout as a support for at least one elongated utensil handle.

These and other aspects of various embodiments of the present system and method will be apparent after consideration of the Detailed Description and Figures herein.

BRIEF DESCRIPTION OF THE DRAWINGS

Non-limiting and non-exhaustive embodiments of the present system and method are described with reference to the following figures, wherein like reference numerals refer to like parts throughout the various views unless otherwise specified.

DETAILED DESCRIPTION

Embodiments are described more fully below with reference to the accompanying figures, which form a part hereof and show, by way of illustration, specific exemplary embodiments. These embodiments are disclosed in sufficient detail to enable those skilled in the art to practice the system and method. However, embodiments may be implemented in many different forms and should not be construed as being limited to the embodiments set forth herein. The following detailed description is, therefore, not to be taken in a limiting sense.

Figure 1:
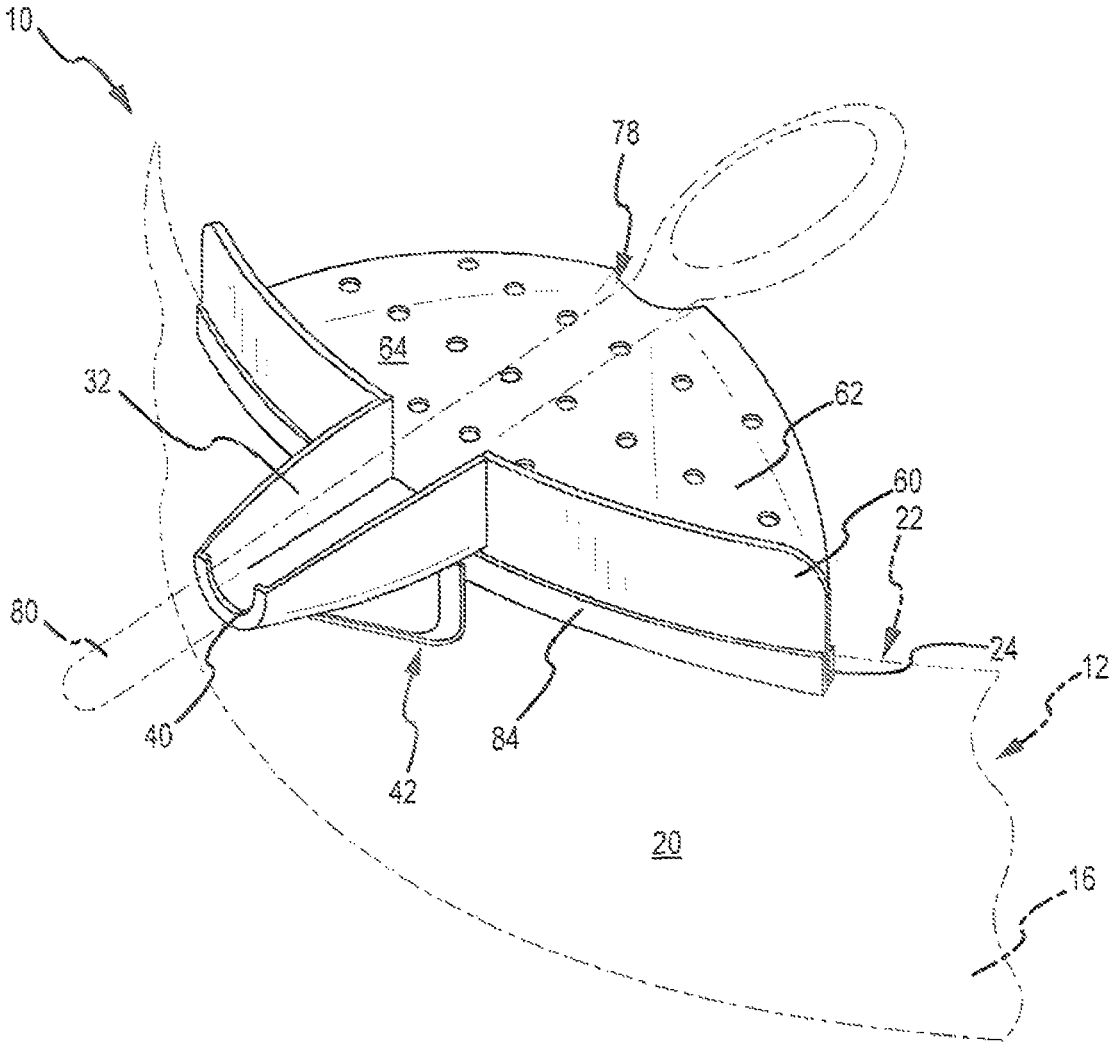
FIG. 1 depicts a perspective view of one embodiment of the system for pouring liquids from a vessel and demonstrates one manner in which the system may engage a vessel.
Figure 2:
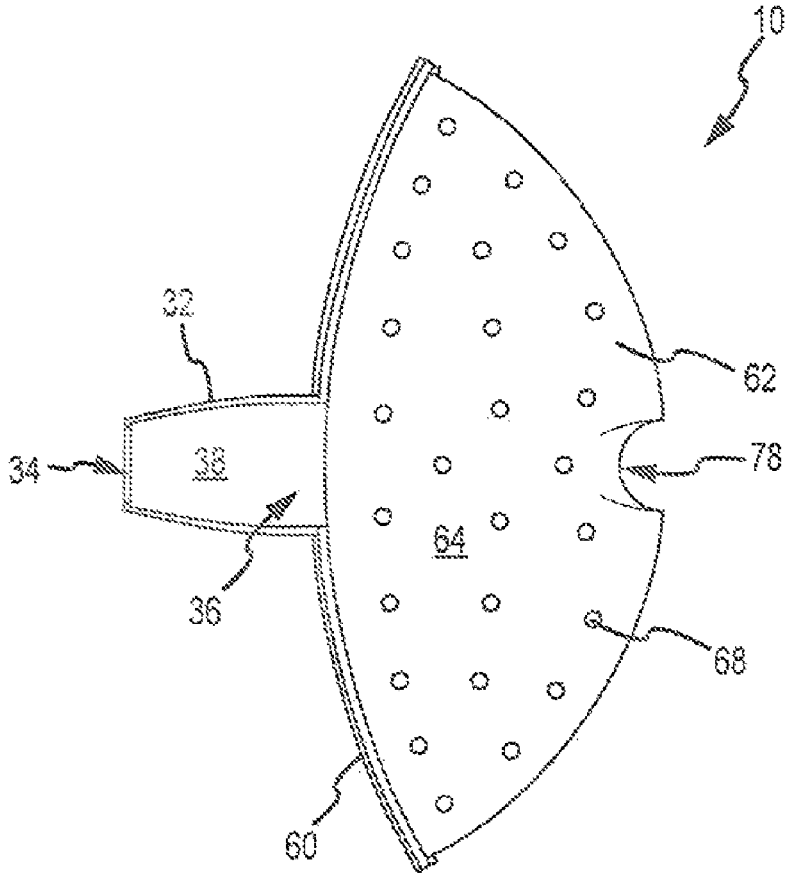
FIG. 2 depicts a top, plan view of the system depicted in FIG. 1.

With reference to FIG. 1 a system 10 is provided for use with one of various different types of cooking vessels 12 for pouring liquids from within the cooking vessel 12. It is contemplated that various different types of cooking vessels 12 may be used with the present system 10, including pots, pans, skillets, and the like. It is also contemplated that the system 10 may be used with cooking vessels 12 having nearly limitless different shapes, depths, and structural configurations. Furthermore, it is contemplated that the liquids for which the system 10 may be used will very greatly and may include nearly any type of liquid used in cooking, such as water, grease, and the like. Moreover, it is contemplated that the liquids being poured using the system 10 may be of a wide range of temperatures experienced during common cooking operations.

Generally speaking, the system 10 will be used with a vessel 12, having at least a bottom wall 14 and a sidewall 16 with an inner surface 18 and an outer surface 20. The cooking vessel 12 will have an open upper end portion defined by a free, circumferential edge portion 22 of the sidewall 16. The system 10 will be provided with a mounting flange 24, having a first surface 26 and an opposite second surface 28. The mounting flange 24 will terminate at a free lower edge portion 30. Preferably the mounting flange 24 is shaped to be placed in a use position, closely adjacent the inner surface 18 and circumferential edge portion 22 of the vessel sidewall 16. A spout 32, having a free distal end portion 34 and a proximal end portion 36 is operatively coupled with, and extends from, the mounting flange 24. A fluid pathway is defined by an upper surface 38 of the spout 32, intermediate the proximal end portion 36 and the distal end portion 34. In one aspect a generally upturned lip member 40 may be provided at the distal end portion 34 of the spout 32. Preferably, the upturned lip member 40 will be shaped to provide an adequate opening through which the liquid may pass. However, the shape of the upturned lip member 40 and its relationship with the spout 32 should be such that drips and spills commonly associated with the surface tension of liquids as they pass from spouts will be greatly reduced.

Figure 3:
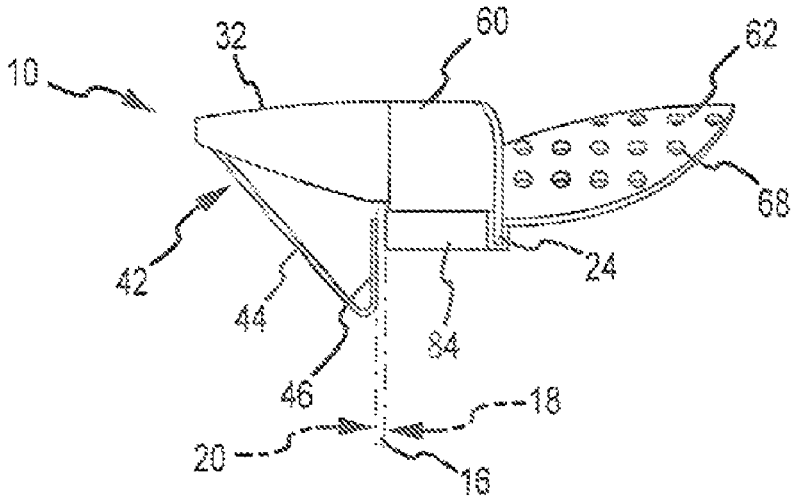
FIG. 3 depicts a side elevation view of the system depicted in FIG. 1.
Figure 4:
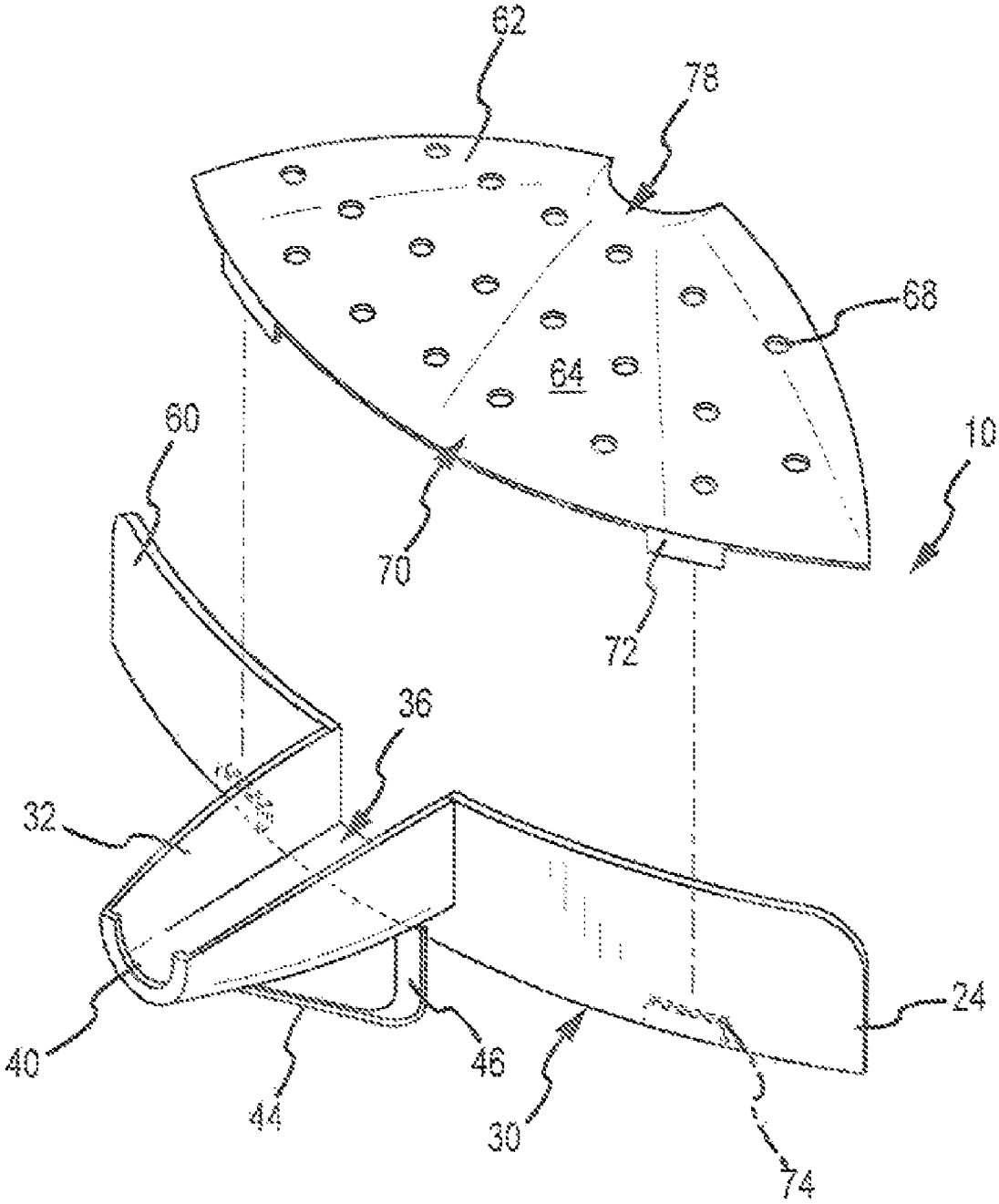
FIG. 4 depicts one contemplated embodiment of the system for pouring liquids from a vessel and demonstrates one manner in which a separator plate may be removably incorporated within the system.

A biasing member 42 is provided to depend downwardly from the spout 32 and should be formed to be generally resilient with regards to its position relative to the spout 32. The biasing member 42 should be positioned so that, when the mounting flange 24 is placed, in its use position, the biasing member 42 at least partially engages the outer surface 20 of the vessel sidewall 16 and exerts a force on the spout 32 and mounting flange 24 that biases the first surface 26 of the mounting flange 24 against the inner surface IS of the vessel sidewall 16. In one aspect, the biasing member may be comprised of a spring. With reference to FIGS. 1, 3 and 4, the biasing member may be provided with a first arm 44 that depends downwardly from the spout 32, toward the mounting flange 24. A second arm 46 may be provided to extend in a generally upward direction to form a distal end of the first arm 44. In this fashion, an outwardly exposed surface of the second arm 46 will engage the outer surface 20 of the vessel sidewall 16. It is contemplated that various non-abrasive or deformably resilient materials may be provided along the outer surface of the second arm 46 to reduce the likelihood that the second arm 46 will scratch the outer surface 20 of the vessel sidewall 16.

Figure 5A:
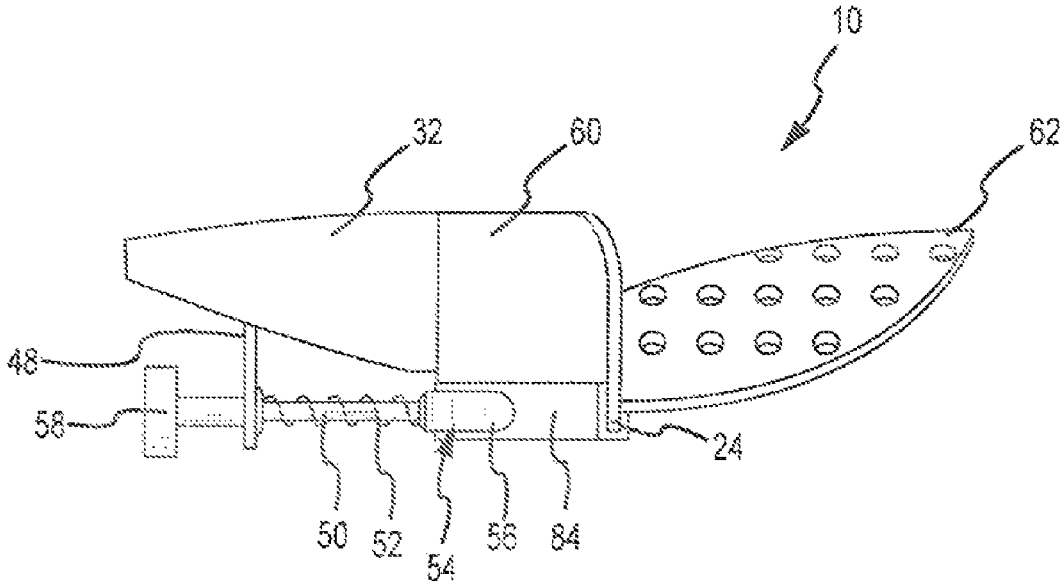
FIG. 5A depicts a side elevation view of one embodiment of the system for pouring liquids from a vessel and demonstrates one manner in which a biasing member may be disposed in an engagement position.
Figure 5B:
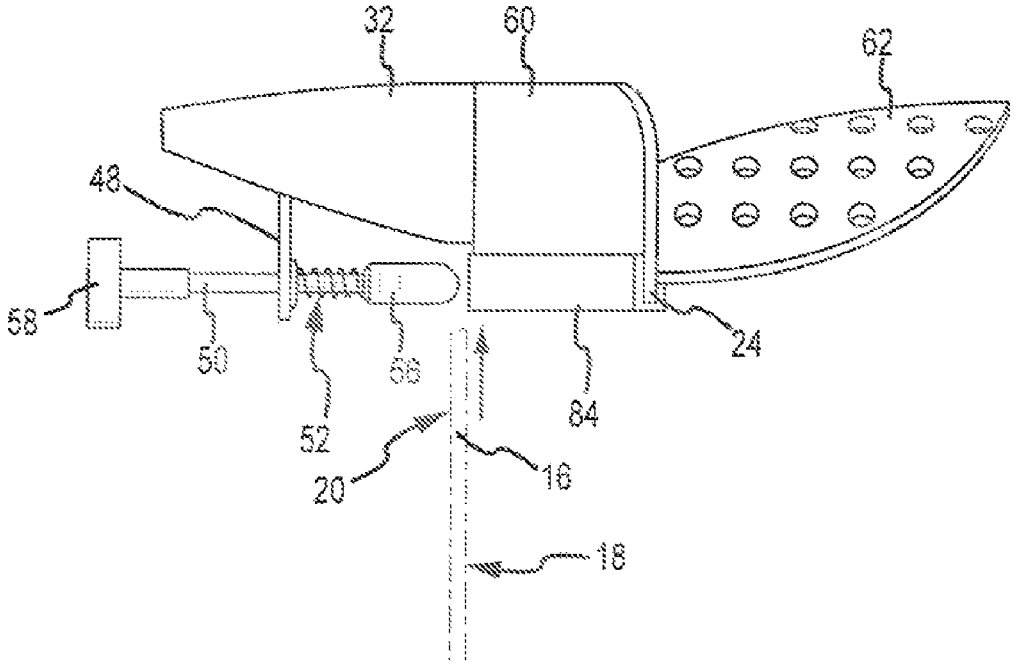
FIG. 5B depicts a side elevation view of the system depicted in FIG. 5A and demonstrates one manner in which a biasing member may be disposed in a release position.
Figure 6:
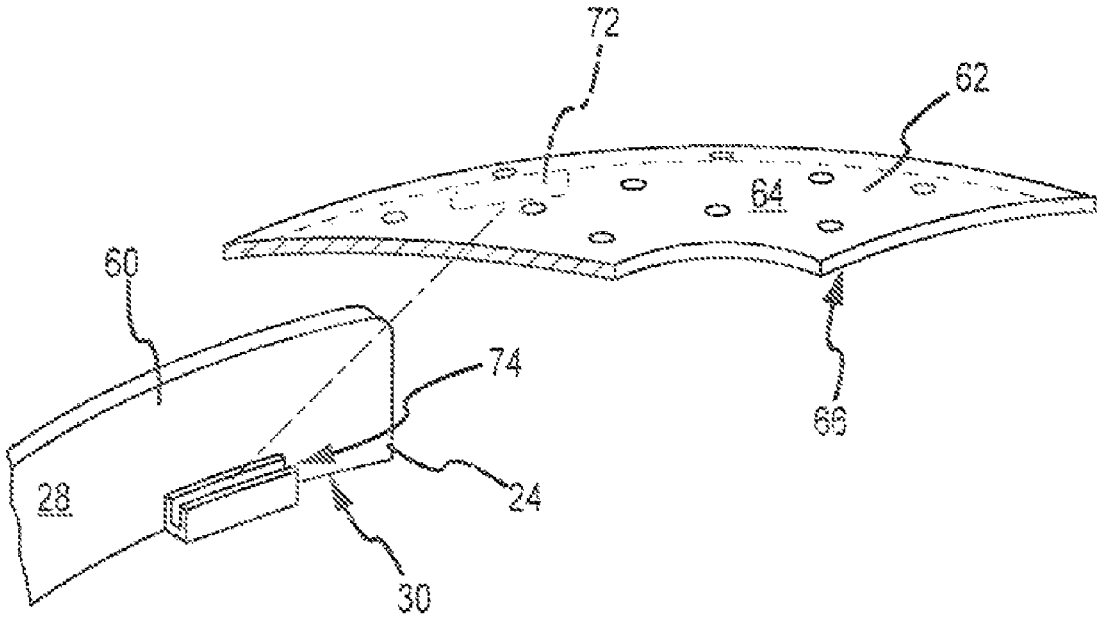
FIG. 6 depicts a partial, exploded view of an embodiment of the system for pouring liquids from a vessel and demonstrates one manner in which a separator plate may be coupled with a mounting flange of the system.
Figure 7:
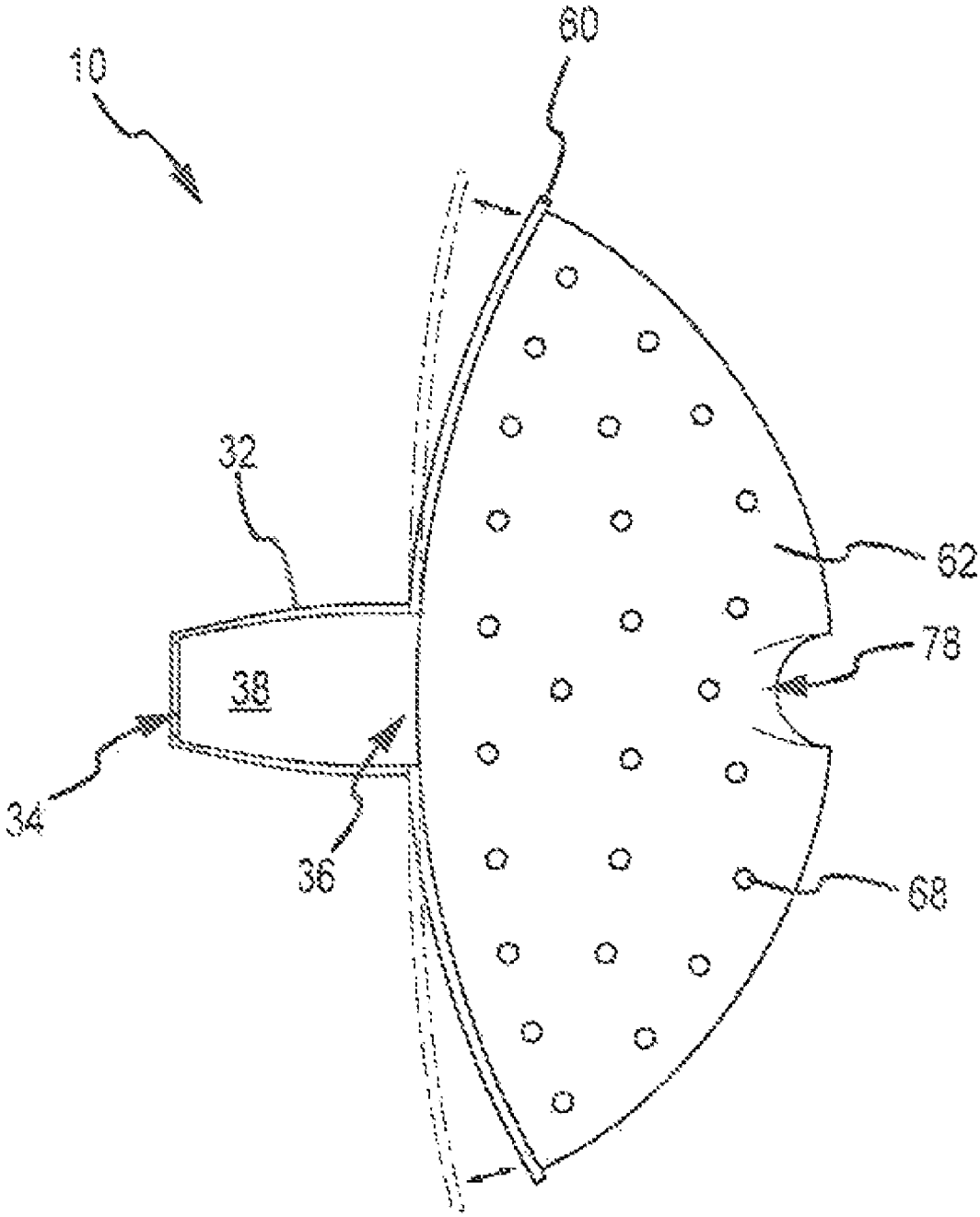
FIG. 7 depicts an embodiment of the system for pouring liquids from a vessel wherein the mounting flange is formed from a deformably resilient material.
Figure 8:
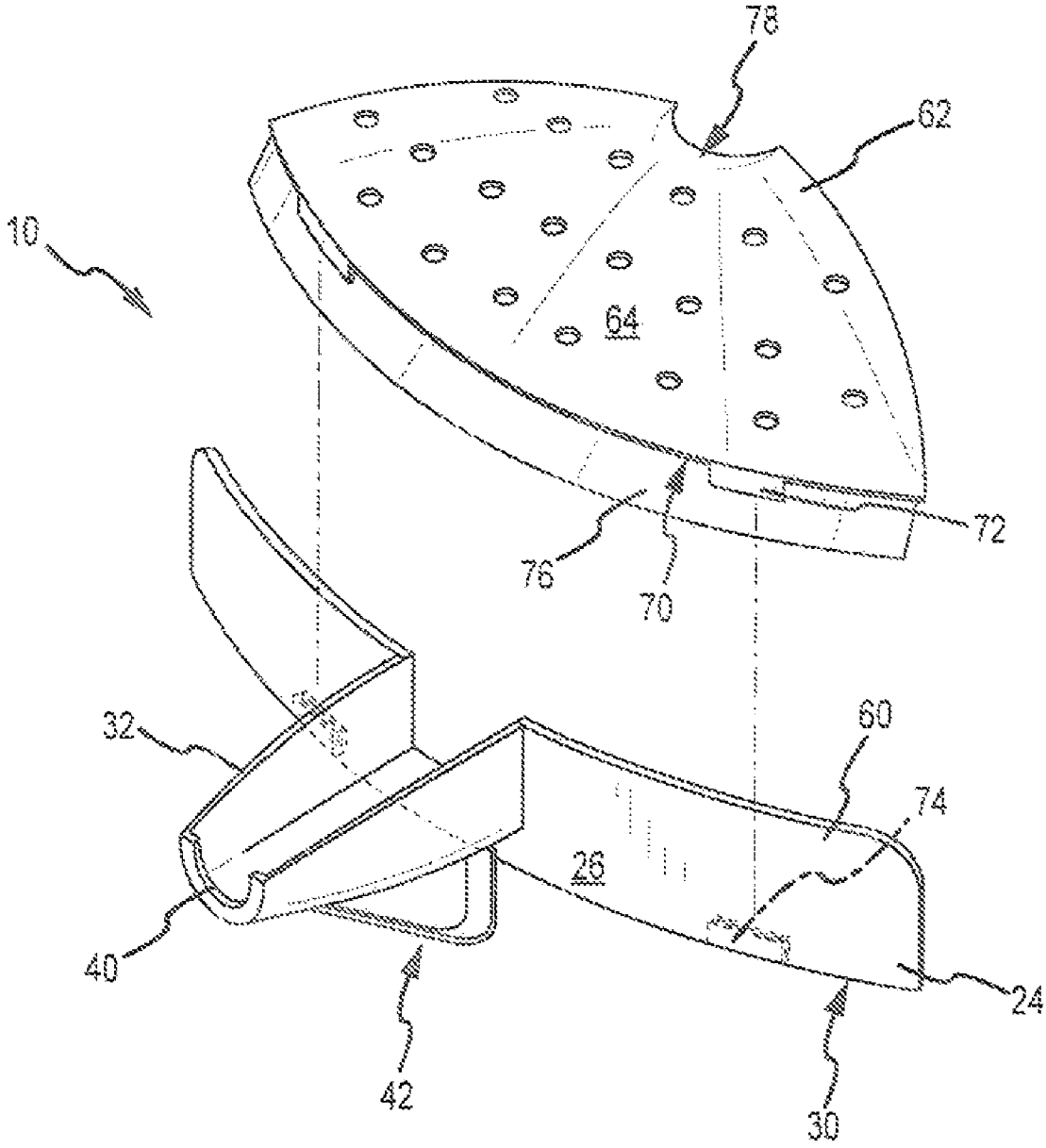
FIG. 8 depicts an alternate embodiment of a separator plate and one manner in which it may be coupled with the system for pouring liquids from a vessel.
Figure 9:
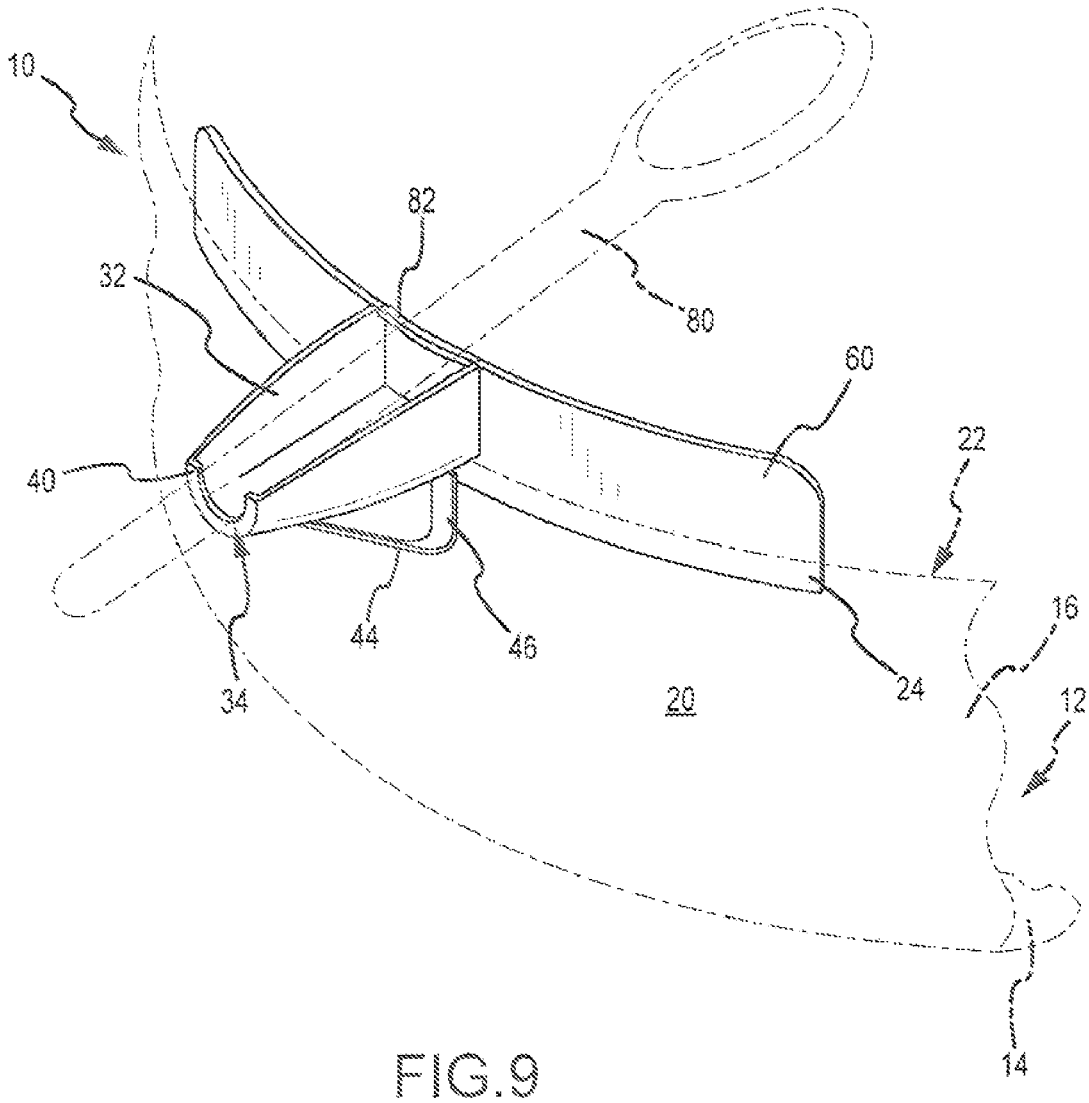
FIG. 9 depicts an alternate embodiment of the system for pouring liquids from a vessel wherein an alternate embodiment of a utensil support is provided.

With reference to FIGS. 5A and 5B, the biasing member 42 may be provided to include at least one bracket 48 that depends downwardly from the spout 32. A support pin 50 may be coupled with the bracket 48 and moveable between an engagement position, such as depicted in FIG. 5A and a release position, such as depicted in FIG. 5B. A spring 52 may be positioned to engage the support pin 50 and bias the support pin toward the engagement position. In this manner, the biasing member 42 will tend to exert a force on the spout 32 and the mounting flange 24 that biases the first surface 26 of the mounting flange 24 against the inner surface of the vessel sidewall 16. It is contemplated that an engagement end portion 54 of the support pin 50 will engage the outer surface 20 of the vessel sidewall 16 with a fair amount of force. Accordingly, an engagement member 56 may be disposed on the engagement end portion 54 of the support pin 50. Constructing the engagement member from a non-abrasive or deformably resilient material will tend to limit the likelihood of damage to the cooking vessel 12 over the life of the system 10. However, due to the likelihood of heat that may travel upwardly along the outer surface 20 of the vessel sidewall 16, it may be preferable to form the engagement member 56 from a heat resistant material, such as silicone and various known polymer blends that provide adequate heat resistance for cooking operations. A handle 58 may be associated with the support pin 50 so that the support pin 50 may be selectively moved between its engagement and release positions.

A pair of guide walls 60 may be positioned on either side of the spout 32, adjacent the proximal end portion 36 of the spout 32 and extending upwardly from the mounting flange 24, to guide materials and liquid into the spout 32. The guide, walls 60 may be coupled, to or integrally formed with the mounting flange 24. Various shapes and dimensions are contemplated for the guide walls 60. However, in one aspect, it may be preferable to provide the guide walls 60 such that they are positioned to extend higher than the circumferential edge portion 22 of the vessel sidewall 16 when the mounting flange 24 is in its use position. Such orientation will help direct fluid and materials from within the cooking vessel 12 into the spout 32 and prevent leaks beyond the sides of the system 10.

In one aspect, the guide walls 60 and the mounting flange 24 may be formed to be deformably resilient so that the mounting flange 24 may be placed into its use position with cooking vessels 12 of differing sidewall edge portion circumferences. To be sure, not all 12 Inch skillets, for example, measure exactly 12 inches in diameter. While such variances will tend to be less than one inch, the flexible nature of the mounting flange 24 and the guide walls 60 will help the system 10 accommodate such size deviations. It is further contemplated that the system 10 will be provided in various shapes and sizes to accommodate the wide range of shapes and sizes of cooking vessels 12 within the cooking industry.

In at least one embodiment, the system 10 may be provided with a separator plate 62, having a first surface 64 and an opposing second surface 66. One or more drainage holes 68, of nearly limitless shapes and configurations, are preferably formed through the separator plate 62 in order to permit the passage of liquid therethrough. While it is contemplated that the separator plate 62 could be permanently coupled within the system 10 or molded as a single piece, at least one preferred embodiment provides the separator plate 62 as a removable feature. In one aspect, the separator plate 62 may be securable with the mounting flange 24 so that an engagement edge portion 70 of the separator plate 62 is positioned closely adjacent the mounting flange 24, below the level of the spout 32. In one aspect, at least one mounting tab 72 may be provided to extend outwardly from the separator plate 62. At least one mounting channel 74 may be associated with the second surface 28 of the mounting flange 24 to align with the at least one mounting tab 72 when the separator plate 62 is placed in a use position with respect to the mounting flange 24. As such, the at least one mounting channel 74 should be shaped and sized to removeably receive the at least one mounting tab 72 and secure the separator plate 62 in its use position. In at least one embodiment, a sealing edge portion 76 may be provided to depend downwardly from the engagement edge portion 70 of the separator plate 62. The sealing edge portion 76 may be formed from a deformably resilient material and positioned along the separator plate 62 so that, when the separator plate 62 and the mounting flange 24 are placed in their use positions, the sealing edge portion 76 of the separator plate 62 creates a seal against the inner surface 18 of the vessel sidewall 16.

In at least one embodiment, the separator plate 62 may be provided with a recessed area 78 in the first surface 64 of the separator plate 62. Preferably, the recessed area 78 will be positioned so that, when the separator plate 62 is in its use position, the recessed area 78 will be in line with the proximal end portion 36 and the distal end portion 34 of the spout 32. The recessed area 78 should be shaped and positioned to function in conjunction with the spout 32 as a support for at least one elongated utensil handle 80, such as that depicted in FIG. 1. As the separator plate 62 may be provided as an optional feature, it is contemplated that a support arm 82 may be provided to extend across the width of the spout 32, adjacent its proximal end portion 36, such that an opening is left between an upper surface 38 of the spout 32 and the support arm 82. Such a support arm 82 should be shaped and positioned to function in conjunction with the distal end portion 34 or upturned lip member 40 of the spout 32 as a support for at least one elongated utensil handle 80.

In at least one embodiment, the system 10 may be provided with a resiliency deformable gasket 84 along the first surface 26 of the mounting flange 24, adjacent the free lower edge portion 30. The gasket 84 should be provided such that, when the mounting flange 24 is in its use position, a seal is created between the first surface 26 of the mounting flange 24 and the inner surface 18 of the sidewall 16. While it is contemplated that the biasing member 42 may exert a sufficient force to create the seal without the use of a gasket 84, it is contemplated that over an extended useful life, the biasing member 42 may tend to lose its resiliency. The use of a gasket 84, as described, will further help the system 10 accommodate various cooking vessels 12 having slightly irregular side walls 16.

Although the above embodiments have been described in language that is specific to certain structures and methodological steps, it is to be understood that the invention defined in the appended claims is not necessarily limited to the specific structures and/or steps described. Rather, the specific aspects and steps are described as forms of implementing the claimed invention. Since many embodiments of the invention can be practiced without departing from the spirit and scope of the invention, the invention resides in the claims hereinafter appended.

What is claimed is:

1. A system for pouring a liquid from a vessel, having at least a bottom wall and a sidewall with inner and outer surfaces and a free circumferential edge portion, the system comprising:

a mounting flange, having first and second opposite surfaces and a free lower edge portion; said mounting flange being shaped to be placed in a use position, closely adjacent the inner surface and circumferential edge portion of the vessel sidewall;

a spout, having a free distal end portion and a proximal end portion that is operatively coupled with said mounting flange; a fluid pathway being defined by an upper surface of said spout intermediate the proximal end portion and the distal end portion; and a biasing member, depending from said spout and formed to be deformably resilient with regards to its position relative said spout; said biasing member being positioned so that, when the mounting flange is placed in said use position, said biasing member at least partially engages the outer surface of the vessel sidewall and exerts a force on said spout and mounting flange that biases the first surface of said mounting flange against the inner surface of the vessel sidewall.

2. The system of claim 1 further comprising:

a pair of guide walls, positioned on either side of said spout, adjacent the proximal end portion of said spout and extending upwardly from said mounting flange, to guide materials into said spout.

3. The system of claim 2 wherein said guide walls are positioned to extend higher than the circumferential edge portion of the vessel sidewall when said mounting flange is in said use position.

4. The system of claim 2 wherein said guide walls and said mounting flange are formed to be deformably resilient so that said mounting flange may be placed into said use position with vessels of differing sidewall edge portion circumferences.

5. The system of claim 1 wherein said biasing member is comprised of a spring, having a first arm depending downwardly from said spout, toward said mounting flange and a second arm that extends in a generally upward direction from a distal end of said first arm.

6. The system of claim 1 wherein said biasing member is comprised of a bracket depending from said spout, a support pin coupled with said bracket and movable between engagement and release positions, and a spring that is positioned to engage said support pin and bias said support pin toward said engagement position.

7. The system of claim 6 wherein said support pin is positioned so that an engagement end portion of said support pin engages the outer surface of the vessel sidewall when the mounting flange is in said use position and said support pin is in said engagement position.

8. The system of claim 7 further comprising:

an engagement member disposed on the engagement end portion of said support pin; said engagement member being formed from a deformably resilient material.

9. The system of claim 8 wherein said engagement member is comprised of heat-resistant silicone material.

10. The system of claim 8 further wherein said support pin is further provided with a handle so that said support pin may be selectively moved between said engagement and release positions.

11. The system of claim 1 further comprising a separator plate, having first and second opposing surfaces and a plurality of drainage holes; said separator plate being removably, operatively securable with said mounting flange so that an engagement edge portion of said separator plate is positioned closely adjacent said mounting flange, below said spout.

12. The system of claim 11 further comprising at least one mounting tab extending outwardly from said separator plate and at least one mounting channel coupled with said mounting plate; said at least one mounting channel being shaped and sized to removably receive said at least one mounting tab and secure said separator plate in a use position with respect to said mounting flange and said spout.

13. The system of claim 12 further comprising:

a sealing edge portion, depending downwardly from the engagement edge portion of said separator plate; said sealing edge portion being formed from a deformably resilient material; said sealing edge portion being positioned on said separator plate such that, when said separator plate and said mounting flange are placed in said use positions, said sealing edge portion of said separator plate creates a seal against the inner surface of the vessel sidewall.

14. The system of claim 11 wherein said separator plate is provided with a recessed area in the first surface of said separator plate that, when said separator plate is in said use position, is in-line with the proximal and distal ends of said spout; said recessed area being shaped and positioned to function in conjunction with said spout as a support for at least one elongated utensil handle.

15. The system of claim 1 wherein the distal end portion of said spout is formed to have an upturned lip that is shaped to limit a tendency of liquids to adhere to an under surface of said spout when liquids are poured through said spout.

16. The system of claim 1 further comprising:

a support arm, extending across a width of said spout, adjacent the proximal end portion of said spout, such that an opening is left between an upper surface of said spout and said support arm.

17. The system of claim 16 wherein said support arm is shaped and positioned to function in conjunction with an upturned lip of said spout as a support for at least one elongated utensil handle.

18. In combination:

a vessel, having at least a bottom wall and a sidewall with inner and outer surfaces and a free circumferential edge portion;

a pouring device, comprising a mounting flange, having first and second opposite surfaces and a free lower edge portion; said mounting flange being shaped to be placed in a use position, closely adjacent the inner surface and circumferential edge portion of the vessel sidewall;

a spout, having a free distal end portion and a proximal end portion that is operatively coupled with said mounting flange; a fluid pathway being defined by an upper surface of said spout intermediate the proximal end portion and the distal end portion;

a pair of guide walls, positioned on either side of said spout, adjacent the proximal end portion of said spout and extending upwardly from said mounting flange, to guide materials into said spout; and a spring-biased member, depending from said spout, that is shoed and positioned to at least partially engages the outer surface of the vessel sidewall and bias the first surface of said mounting flange against the inner surface of the vessel sidewall.

19. The system of claim 18 further comprising a separator plate, having first and second opposing surfaces and a plurality of drainage holes; said separator plate being removably, operatively securable with said mounting flange so that an engagement edge portion of said separator plate is positioned closely adjacent said mounting flange, below said spout.

20. The system of claim 18 further comprising a resiliently deformable gasket disposed along the first surface of said mounting flange, adjacent the free lower edge portion of said mounting flange, so that, when said mounting flange is in said use position, a seal is created between the first surface of said mounting flange and the inner surface of the vessel sidewall.

* * * * *